US009861176B2

(12) United States Patent
Jung

(10) Patent No.: US 9,861,176 B2
(45) Date of Patent: Jan. 9, 2018

(54) PISTON STRUCTURE OF PUMPING TYPE COSMETIC CONTAINER

(71) Applicant: YONWOO CO., LTD., Incheon (KR)

(72) Inventor: Shin-Bok Jung, Incheon (KR)

(73) Assignee: YONWOO CO., LTD., Incheon (KR)

( * ) Notice: Subject to any disclaimer, the term of this patent is extended or adjusted under 35 U.S.C. 154(b) by 29 days.

(21) Appl. No.: 14/907,201

(22) PCT Filed: Jul. 8, 2014

(86) PCT No.: PCT/KR2014/006085
§ 371 (c)(1),
(2) Date: Jan. 22, 2016

(87) PCT Pub. No.: WO2015/012512
PCT Pub. Date: Jan. 29, 2015

(65) Prior Publication Data

US 2016/0157582 A1 Jun. 9, 2016

(30) Foreign Application Priority Data

Jul. 22, 2013 (KR) ..... 10-2013-0086169

(51) Int. Cl.
*B05B 11/00* (2006.01)
*A45D 40/00* (2006.01)

(52) U.S. Cl.
CPC ..... *A45D 40/0075* (2013.01); *B05B 11/0048* (2013.01); *B05B 11/3023* (2013.01);
(Continued)

(58) Field of Classification Search
CPC ..... A45D 40/0075; A45D 2200/055; A45D 2200/056; B05B 11/0048; B05B 11/3028;
(Continued)

(56) References Cited

U.S. PATENT DOCUMENTS 2,815,151 A * 12/1957 Collins ..... B05C 17/0123 178/17 R
5,769,824 A * 6/1998 Hjertman ..... A61M 5/14526 604/131

(Continued)

FOREIGN PATENT DOCUMENTS

KR 20-0235847 10/2001
WO WO-2010114200 A1 10/2010
WO WO-2012005441 A2 1/2012

OTHER PUBLICATIONS

International Search Report from International Application No. PCT/KR2014/006085 dated Oct. 15, 2014.

*Primary Examiner* — Frederick C Nicolas

(74) *Attorney, Agent, or Firm* — Marshall, Gerstein & Borun LLP

(57) ABSTRACT

A piston structure of a pumping-type cosmetic container. The piston structure includes two pistons which come into close contact with an inner wall of a container body and are overlapped. During a pumping operation, a first piston firstly ascends to a certain section and then lifts up a second piston located on the lower part thereof such that the first piston and the second piston ascend together; thus, it is possible to reduce the volume taken up by the pistons when the contents are initially filled, while the thickness for a normal operation of the pistons is still maintained, so that relatively more contents for the same volume can be filled in the same container.

1 Claim, 4 Drawing Sheets

(52) U.S. Cl.
CPC .... *B05B 11/3028* (2013.01); *A45D 2200/055* (2013.01); *A45D 2200/056* (2013.01); *B05B 11/007* (2013.01); *B05B 11/0072* (2013.01); *B05B 11/3025* (2013.01); *B05B 11/3074* (2013.01)

(58) Field of Classification Search
CPC ..... B05B 11/3023; B05B 11/0072; B05B 11/3025; B05B 11/3074; B05B 11/007
See application file for complete search history.

(56) References Cited

U.S. PATENT DOCUMENTS

| | | | | |
|---|---|---|---|---|
| 6,149,628 | A * | 11/2000 | Szapiro | A61M 5/31596 604/191 |
| 6,634,524 | B1 * | 10/2003 | Helmenstein | B05C 17/00553 222/105 |
| 9,101,713 | B2 * | 8/2015 | Cowan | A61M 5/007 |
| 9,609,936 | B2 * | 4/2017 | Kim | A45D 40/0075 |
| 2012/0024907 | A1 | 2/2012 | Law et al. | |
| 2012/0136298 | A1 * | 5/2012 | Bendix | A61M 5/2448 604/89 |
| 2013/0056494 | A1 * | 3/2013 | Pires | G01F 11/021 1/21 |
| 2013/0140332 | A1 | 6/2013 | Csaszar | |
| 2013/0161352 | A1 * | 6/2013 | Bodet | B05B 11/0048 222/135 |

* cited by examiner

PISTON STRUCTURE OF PUMPING TYPE COSMETIC CONTAINER

CROSS-REFERENCE TO RELATED APPLICATIONS

This U.S. utility patent application is a national stage application under 35 U.S.C. §371 of international application PCT/KR2014/006085, filed Jul. 8, 2014, and claims the benefit of priority under 35 U.S.C. §119 of Korean Patent Application No. 10-2013-0086169, filed Jul. 22, 2013, the entire contents of which are hereby incorporated herein by reference for all purposes.

TECHNICAL FIELD

The present invention relates to a piston structure of a pumping-type cosmetic container, and more particularly, to a piston structure of a pumping-type cosmetic container including two pistons which are closely contact with an inner wall of a container body, overlapping each other, wherein, during a pumping operation, a first piston firstly ascends by to a predetermined section, and then lifts up a second piston located under the first piston such that the first and the second pistons ascend together, and thus the volume taken up by the pistons can be reduced when contents are initially filled while a thickness for a normal operation of the pistons is maintained, so that relatively more contents can be filled in the same container having the same volume.

BACKGROUND

In general, a pumping-type cosmetic container includes: a container body for storing contents; a piston which is installed at an inner lower portion of the container body and ascends as the contents are discharged; and a pumping means coupled to an upper portion of the container body and discharging the contents stored in the container body by a pumping operation.

The piston installed in the pumping-type cosmetic container like the above is required to allow a sidewall portion thereof in contact with an inner wall of the container body to secure a thickness thicker than a predetermined height in order to prevent a phenomenon in which the piston is upside down due to an internal pressure of the container body during an ascending operation of the piston. However since the piston takes up a lot of inner space of the container body due to the thickness of the piston for a normal operation, there is a problem in that the contents may not be filled by the space taken up by the piston.

Korean utility model registration No. 20-0235847 entitled "Piston of dispenser container" was proposed by the applicant in order to resolve the problem.

The utility model registration is characterized in that a dispenser container includes: a container part 10 for storing contents; a piston 20 which is installed in the container part 10 and ascends as the contents are discharged; and a pumping part 30 coupled to an upper end portion of the container part 10, for discharging the contents to the outside, wherein the piston 20 includes: an inner piston 21 formed in a tubular shape and having an opened upper surface, a bottom 23, and a sidewall 22, the inner piston 21 having locking jaws 24 and 25 each of which is formed on outer circumferential surfaces of an upper end portion and a lower end portion thereof; and an outer piston 26 liftably coupled to the outer circumferential surface of the inner piston 21, the outer piston 26 ascending while an outer circumferential surface thereof is in close contact with an inner wall surface of the container part 10, and wherein the outer piston 26 is positioned at a lower end portion of the inner piston 21 to reduce unused space of the container part 10 while the contents are filled in the container part 10, and the outer piston 26 ascends to the upper end portion of the inner piston 21 to reduce a remaining amount of the contents after the contents are completely discharged.

The utility model registration having the above-described configuration is configured such that the inner piston 21 is formed in the shape of a hollow cylinder having an opened upper portion to fill the contents therein, and thus relatively more contents may be filled in the container having the same volume, and the outer piston 26 ascends to the upper end portion of the inner piston 21 when the contents are completely discharged such that the remaining amount of the contents is reduced.

However, since the utility model registration employs a structure in which the bottom 23 of the inner piston 21 partially contacts the lower portion of the pumping unit 30 during the ascending of the piston 20 due to consumption of the contents, the discharge of the contents by the pumping operation is not smoothly performed within a section in which the outer piston 25 independently ascends, and thus there was a problem in that wasted unused contents still occurred.

Thus, there was a problem in that even though it was possible to fill a relatively larger amount of contents in a container having the same volume, there was little difference in the amount of contents that users could substantially use up.

SUMMARY

The present invention is devised to solve the problems described above, and an object of the present invention is to provide a piston structure of a pumping-type cosmetic container, the piston structure including two pistons which closely contact an inner wall of a container body and overlap each other, wherein, during a pumping operation, a first piston firstly ascends by a predetermined section, and then a second piston located thereunder is lifted up such that the first and second pistons ascend together, and thus the volume taken up by the pistons can be reduced when contents are initially filled while a thickness for a normal operation of the pistons is maintained, so that relatively more contents can be filled in the same container having the same volume.

To solve the above-described problems, a piston structure of a pumping-type cosmetic container according to the present invention, the pumping-type cosmetic container including a piston which is installed inside a container body receiving contents therein and ascends as the contents are consumed by a pumping operation of a pumping means, is characterized in that:

the piston includes a first piston having a hollow cavity, and a second piston having a closed upper end portion and liftably coupled to the hollow cavity, wherein the second piston is positioned overlapping the first piston when the contents are initially filled, the second piston is configured to first ascend independently as the contents are consumed and to then lift the first piston such that the first and second pistons ascend together, and the first and second pistons are configured to ascend while the first and second pistons are in close contact with an inner wall of the container body.

Further, the piston structure is characterized in that a locking jaw is formed on an inner upper portion of the first piston to surround an inner circumferential surface of the first piston such that the first and second pistons ascend together while being in contact with each other.

Furthermore, the piston structure is characterized in that a coupling portion which is liftably coupled to the hollow cavity of the first piston is provided to a lower central portion of the second piston, wherein the coupling portion includes a locking protrusion formed on a lower outer circumferential surface thereof such that the first and second pistons ascend together while the locking protrusion is in contact with the locking jaw.

As described above, according to the present invention, in two pistons which are in close contact with an inner wall of a container body and overlap each other, a first piston firstly ascends to a predetermined section by a pumping operation and thus a second piston located thereunder is then lifted up such that the first and the second pistons ascend together. Thus, since the volume taken up by the pistons can be reduced when contents are initially filled while a thickness for a normal operation of the pistons is maintained, it is advantageous that relatively more contents can be filled in the same container having the same volume.

DETAILED DESCRIPTION

Figure 1:
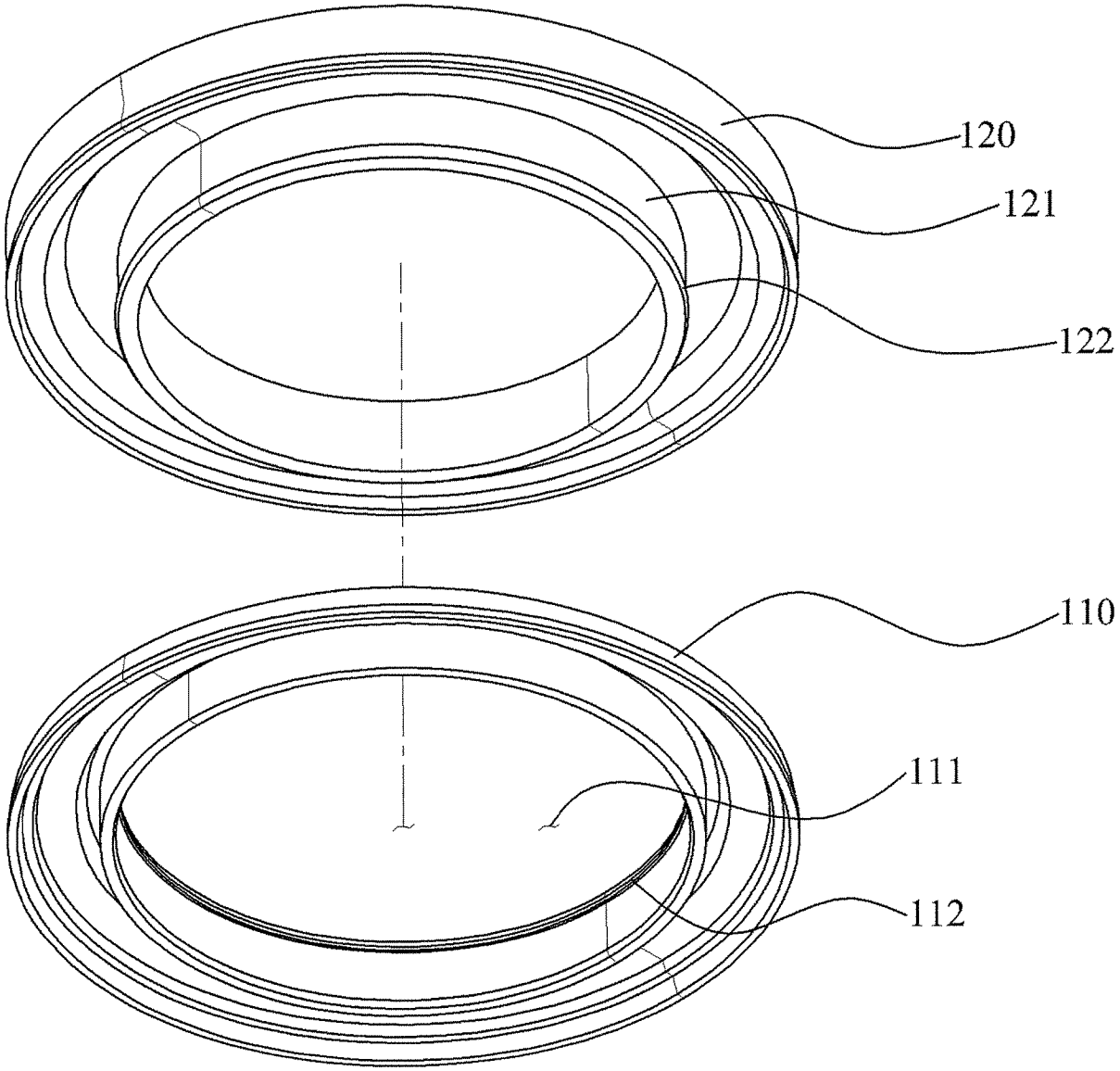
FIG. 1 is an exploded perspective view illustrating elements of a piston structure of a pumping-type cosmetic container according to a preferred embodiment of the present invention.

Hereinafter, the present invention will be described in detail with reference to the drawings. Like reference numerals refer to like elements throughout.

Figure 2:
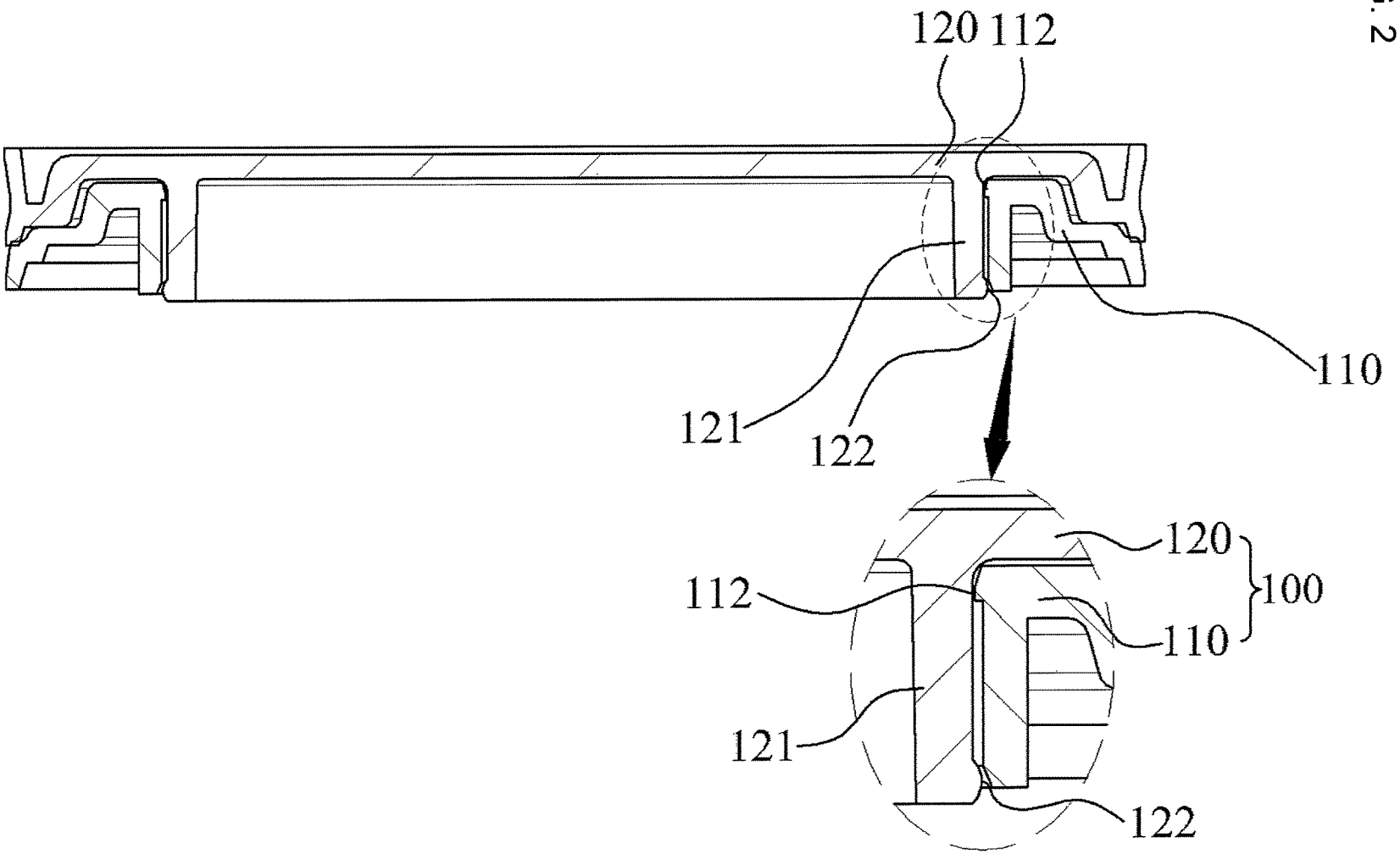
FIG. 2 is a cross-sectional view illustrating a coupled piston structure of a pumping-type cosmetic container according to a preferred embodiment of the present invention.
Figure 3:
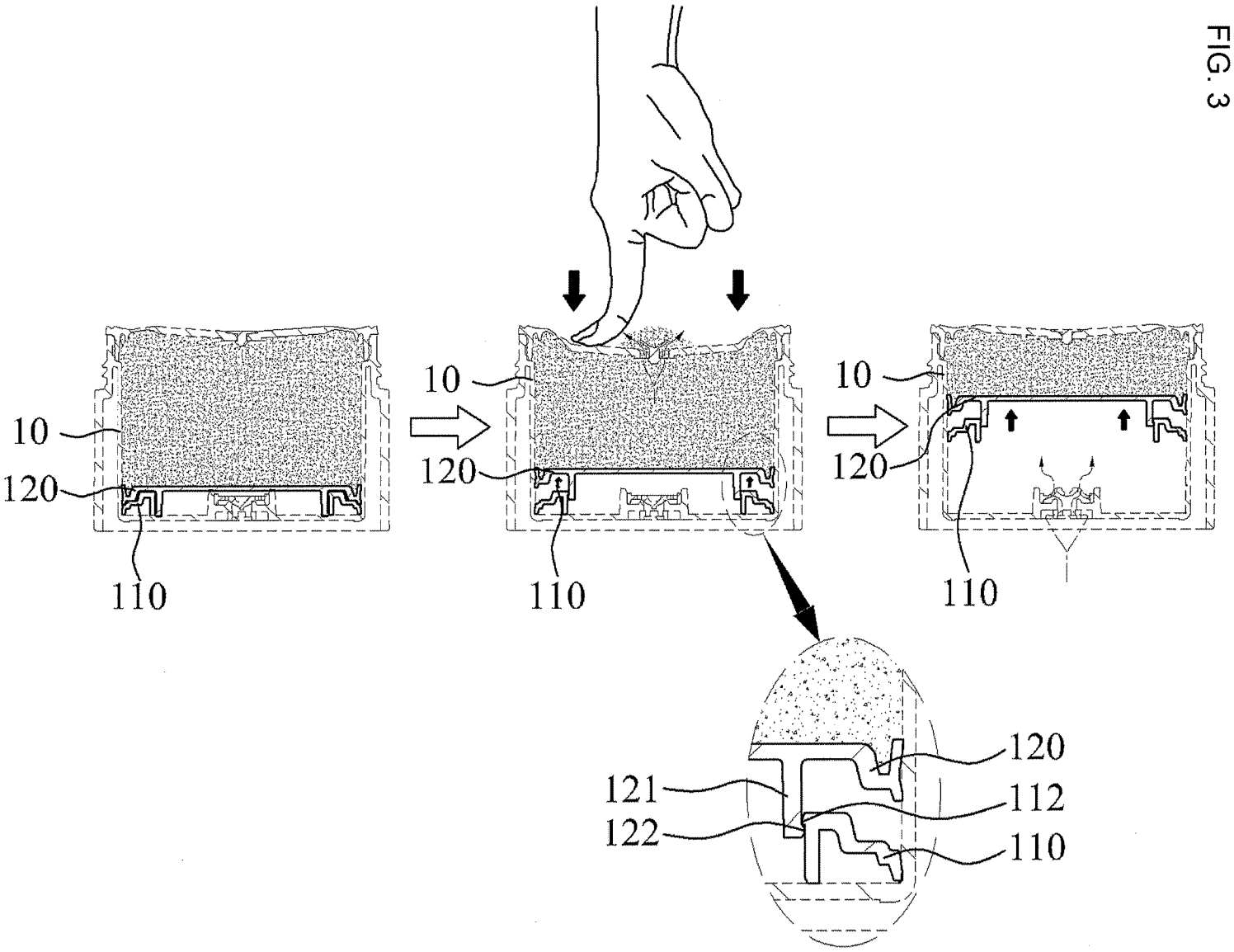
FIGS. 3 and 4 are schematic diagrams illustrating operations of a piston installed in a pumping-type cosmetic container according to a preferred embodiment of the present invention.
Figure 4:
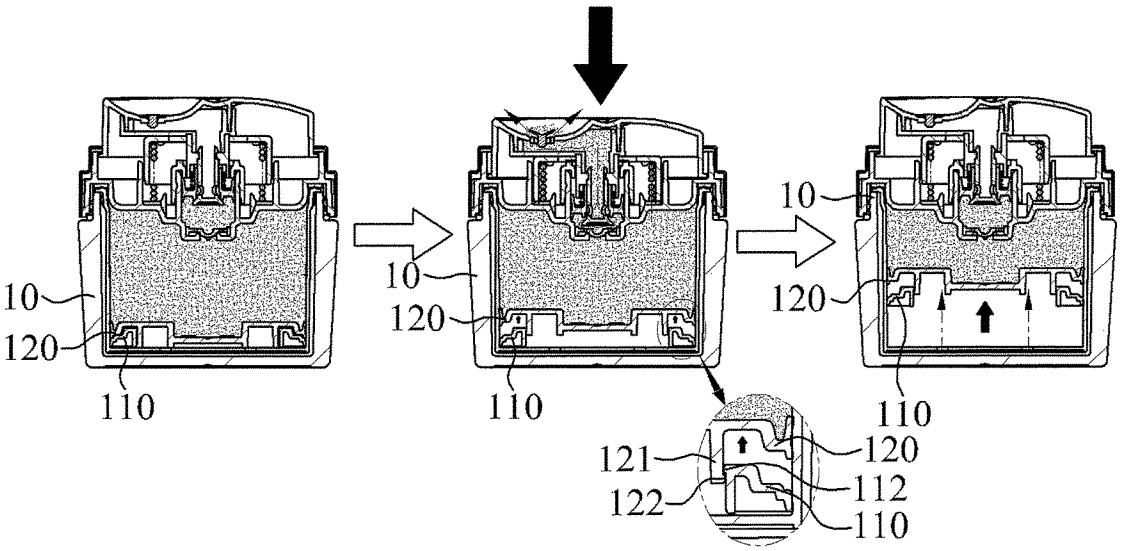

FIG. 1 is an exploded perspective view illustrating constituents of a piston structure of a pumping-type cosmetic container according to a preferred embodiment of the present invention, FIG. 2 is a cross-sectional view illustrating a coupled piston structure of a pumping-type cosmetic container according to a preferred embodiment of the present invention, and FIGS. 3 and 4 are schematic diagrams illustrating operations of a piston installed in a pumping-type cosmetic container according to a preferred embodiment of the present invention.

Referring to FIGS. 1 to 4, a piston 100 of a pumping-type cosmetic container according to a preferred embodiment of the present invention is installed inside a container body 10 in which contents are received, and includes a first piston 110 and a second piston 120, the piston 100 being configured to ascend as the contents are consumed.

The first piston 110 is in close contact with an inner wall of the container body 10 such that the first piston 110 may ascend together with the second piston 120 as the second piston 120 which will be described below ascends, and a hollow cavity 111 is formed such that a coupling portion of the second piston 120 is coupled thereto.

In the present invention, the first piston 110 is characterized by including a locking jaw 112 formed on an inner upper portion thereof to surround an inner circumferential surface such that the first piston 110 may ascend together with the second piston 120 while the first piston is in close contact with the second piston, and a locking protrusion 122 of the second piston 120 is configured to be in contact with a lower end of the locking jaw 112 as the second piston 120 ascends such that the first piston 110 possibly ascends together with the second piston 120 as the second piston 120 ascends.

The second piston 120 is located in close contact with the inner wall of the container body 10, is liftably coupled to the hollow cavity 111, and has a closed upper end portion, and in the present invention, the second piston 120 is characterized in that the second piston 120 is located overlapping the first piston 110 when the contents are initially filled, then the second piston 120 firstly ascends independently as the contents are consumed, and thus the first piston 110 is lifted up such that the first and the second pistons 110 and 120 ascend together.

For this, a coupling portion 121 which is liftably coupled to the hollow cavity 111 of the first piston 110 is provided to a lower central portion of the second piston 120, and a locking protrusion 122 is formed on an outer circumferential surface of the coupling portion 121 such that the locking protrusion 122 is in contact with the lower section of the locking jaw 112 while the second piston 120 ascends, and thus the second piston 120 and the first piston 110 may ascend together by the locking protrusion.

Hereinafter, operations of the piston installed in the pumping-type cosmetic container according to a preferred embodiment of the present invention will be described with reference to FIGS. 3 and 4.

FIGS. 3 and 4 are schematic diagrams illustrating operations of the piston installed in the pumping-type cosmetic container according to a preferred embodiment of the present invention.

Referring to FIGS. 3 and 4, the piston installed in the pumping-type cosmetic container according to a preferred embodiment of the present invention is configured such that the first piston 110 and the second piston 120 are located overlapping each other after the contents are initially filled, and when a user performs a pumping operation using a pumping means provided on an upper portion of the container body 10, the second piston 120 firstly ascends independently until the locking protrusion 122 of the second piston 120 contacts the locking jaw 112 of the first piston 110, and the second piston 120 then ascends together with the first piston 110 by lifting the first piston 110.

As described above, according to the present invention, the piston 100 installed inside the container body 10 is configured to include the first and the second pistons 110 and 120, wherein the first and the second pistons 110 and 120 are located overlapping each other when the contents are initially filled such that the thickness of the piston is made thin, thus the volume taken up by the piston may be reduced, and thus relatively more contents can be filled in the same container having the same volume, and also the first piston firstly ascends to a predetermined section and then lifts up the second piston provided thereunder such that the first and the second pistons ascend together, and thus a thickness for a normal operation of the pistons can be maintained.

Hitherto, the best mode has been disclosed in the drawings and specification. Although the specific terms have been used herein, they have been used merely for the purpose of describing the present invention, and have not been used to limit the meanings thereof and the scope of the present invention set forth in the claims. Therefore, it will be understood by those having ordinary knowledge in the art that various modifications and other equivalent embodiments can be made. Hence, the technical range of the present invention shall be defined by the technical spirit of the accompanying claims.

The invention claimed is:

1. A piston structure of a cosmetic container, the cosmetic container comprising:

a piston which is installed inside a container body receiving contents therein, wherein the piston ascends as the contents are consumed by a pumping operation, wherein the piston comprises:

a first piston having a hollow cavity; and a second piston having a closed upper end portion and liftably coupled to the hollow cavity, wherein the second piston overlaps the first piston when the contents are initially filled and is configured to firstly ascend independently of the first piston as the contents are consumed, the second piston configured to subsequently lift the first piston such that the first and the second pistons ascend together, wherein the first and the second pistons are configured to ascend while the first and the second pistons are in close contact with an inner wall of the container body, wherein a locking jaw is formed on an inner upper portion of the first piston to surround an inner circumferential surface of the first piston such that the first and the second pistons ascend together while being in contact with each other, wherein a coupling portion which is liftably coupled to the hollow cavity of the first piston is provided to a lower central portion of the second piston, wherein the coupling portion comprises a locking protrusion formed on a lower outer circumferential surface thereof such that the first and the second pistons ascend together while the locking protrusion is in contact with the locking jaw.

* * * * *